US011383211B2

(12) United States Patent
Nasman et al.

(10) Patent No.: US 11,383,211 B2
(45) Date of Patent: Jul. 12, 2022

(54) POINT-OF-USE DYNAMIC CONCENTRATION DELIVERY SYSTEM WITH HIGH FLOW AND HIGH UNIFORMITY

(71) Applicant: Tokyo Electron Limited, Tokyo (JP)

(72) Inventors: Ronald W. Nasman, Albany, NY (US); Lior Huli, Albany, NY (US); Anton deVilliers, Clifton Park, NY (US); Rodney Robison, East Berne, NY (US); Norman Jacobson, Albany, NY (US); James Grootegoed, Albany, NY (US)

(73) Assignee: Tokyo Electron Limited, Tokyo (JP)

( * ) Notice: Subject to any disclaimer, the term of this patent is extended or adjusted under 35 U.S.C. 154(b) by 506 days.

(21) Appl. No.: 16/560,481

(22) Filed: Sep. 4, 2019

(65) Prior Publication Data

US 2020/0338510 A1 Oct. 29, 2020

Related U.S. Application Data

(60) Provisional application No. 62/839,917, filed on Apr. 29, 2019.

(51) Int. Cl.

| | |
|---|---|
| ***B01F 15/00*** | (2006.01) |
| ***B01F 13/00*** | (2006.01) |
| ***B01F 7/00*** | (2006.01) |
| ***B01F 35/71*** | (2022.01) |
| ***B01F 33/30*** | (2022.01) |
| ***B01F 35/221*** | (2022.01) |
| *B01F 25/40* | (2022.01) |

(52) U.S. Cl.
CPC ..... *B01F 35/711* (2022.01); *B01F 33/30* (2022.01); *B01F 35/2211* (2022.01); *B01F 25/40* (2022.01)

(58) Field of Classification Search
CPC .... B01F 35/711; B01F 33/30; B01F 33/3011; B01F 35/2211; B01F 25/40
See application file for complete search history.

(56) References Cited

U.S. PATENT DOCUMENTS

2007/0177458 A1* 8/2007 Meiners ..... B01F 25/4321 366/340
2007/0248958 A1* 10/2007 Jovanovich ..... B01F 31/65 435/6.19

OTHER PUBLICATIONS

WO2018142166A1 to Radford (Year: 2018).*
International Search Report and Written Opinion dated Jul. 9, 2020 in PCT/US2020/024387, 9 pages.

* cited by examiner

*Primary Examiner* — Anshu Bhatia
(74) *Attorney, Agent, or Firm* — Oblon, McClelland, Maier & Neustadt, L.L.P.

(57) ABSTRACT

A method and a system are described for mixing liquid chemicals at dynamically changing or static ratios during a given dispense, with extremely high uniformity and repeatability. A mixer includes multiple fluid supply lines including elongate bladders defining a linear flow path and being configured to laterally expand to collect a process fluid and laterally contract to deliver a selected volume of the process fluid to the mixer.

20 Claims, 7 Drawing Sheets

A-Nozzle
B-Flow Sensor
C-Flow Sensor
D-NA
E-Pneumatic Value
F-Bladder Unit
G-Pressure Transender
H-Filter
I-PreFilter Process Transducer
J-Pneumatic Value
K-Pressure Transducer
L-Needle Value
M-Resist Source
N-Needle Value
O-Compressed Air
P-Pressure regulator
Q-Pneumatic Signal
R-Needle Value

POINT-OF-USE DYNAMIC CONCENTRATION DELIVERY SYSTEM WITH HIGH FLOW AND HIGH UNIFORMITY

CROSS REFERENCE TO RELATED APPLICATIONS

This application is based on and claims the benefit of and priority to U.S. Provisional Patent Application No. 62/839,917, entitled "POINT-OF-USE DYNAMIC CONCENTRATION DELIVERY SYSTEM WITH HIGH FLOW AND HIGH UNIFORMITY", filed on Apr. 29, 2019, the entire contents pf which are herein incorporated by reference.

BACKGROUND

Technical Field

The present application relates to mixing and dispensing fluids, especially for use in semiconductor microfabrication. More particularly, it relates to a method and a system for providing a precise supply of chemicals to a mixer with extremely high uniformity and repeatability and also providing variable blending within the dispensed chemical.

Description of Related Art

Liquid chemicals are used in multiple semiconductor manufacturing processes including, but not limited to, the application of photoresists, developers, antireflective coatings, etching chemicals, solvents and cleaning solutions. These chemicals are often chemical mixtures with extremely precise ratios of reactive and nonreactive components. The ultra-small feature size of semiconductor devices drives the high purity and mix quality and uniformity requirements of these chemicals as variability of concentration negatively impacts critical feature parameters such as CD (critical dimension), LWR (line width roughness) and LER (line edge roughness). With feature sizes now below 10 nm, high purity and quality mixes are challenging to achieve. For example, conventional chemical suppliers often expend substantial time and effort using proprietary mixing equipment to provide a bulk supply of highly uniform liquid chemical solutions.

In semiconductor manufacturing, mixing or blending chemicals at the point of dispense on the wafer can be highly desirable. Previous attempts include viscosity control by using an on-tool solvent and resist mixer that uses a conventional mixer and adjusts valves between each dispense to arrive at an acceptable setting based on thickness measurements. Another attempt uses a viscometer to control flows of photoresist and solvent into a mixer. While conventional attempts provide some mixing benefits with static concentrations, they fail to provide mixture uniformity required in sub 10 nm microfabrication.

SUMMARY

Techniques disclosed herein provide systems and methods that mix liquid chemicals at dynamically changing, phasing, or static ratios during a given dispense, with extremely high uniformity and repeatability. Uniformity and repeatability is at a rate high enough to support an even dispense from a nozzle without drops, drips or a break in stream. Accordingly, such devices and methods enable new dispense techniques in semiconductor manufacturing including dynamically changing a mixture concentration during a dispense. Features of systems described herein can reduce resist dispense volume, reduce the number of dispenses, and reduce associated processing time. The ability to uniformly mix chemicals on a given tool at a point of use opens up multiple process capabilities, improves process results, and reduces processing time.

Hardware described herein can use a single chemical (resist, developer, rinse agent, metal or non-metal solutions, organic or inorganic solutions, et cetera) concentration and uniformly blend in a solvent, or other chemical, to produce a different viscosity or other liquid property. Hardware described herein can be used to provide variable blending within the dispense to reduce undesirable effects of changing chemicals too quickly, such as the elimination of the negative effects of rapid changes in pH during TMAH/DI water photoresist developer process.

Hardware described herein enables implementation of chemical mixtures and solutions that were previously unavailable to be used in production due to the fact that the solutions were unstable and the solutions reacted, decomposed, or precipitated out of solution in a very short period of time. By mixing reactive components directly at the point of use, these chemicals can now be dispensed in production without concern for the shelf life of the chemical.

The order of the different steps as described herein is presented for clarity sake. In general, these steps can be performed in any suitable order. Additionally, although each of the different features, techniques, configurations, etc., herein may be discussed in different places of this disclosure, it is intended that each of the concepts can be executed independently of each other or in combination with each other. Accordingly, the features of the present application can be embodied and viewed in many different ways.

This summary section does not specify every embodiment and/or novel aspect of the present application. Instead, this summary only provides a preliminary discussion of different embodiments and corresponding points of novelty over conventional techniques. Additional details and/or possible perspectives of the disclosed embodiments are described in the Detailed Description section and corresponding Figures of the present disclosure as further discussed below.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Reference throughout this specification to "one embodiment" or "an embodiment" means that a particular feature, structure, material, or characteristic described in connection with the embodiment is included in at least one embodiment of the application, but does not denote that they are present in every embodiment. Thus, the appearances of the phrases "in one embodiment" or "in an embodiment" in various places throughout this specification are not necessarily referring to the same embodiment of the application. Furthermore, the particular features, structures, materials, or characteristics may be combined in any suitable manner in one or more embodiments.

Techniques described herein combine an ability to precisely control liquid fluid supply, using a digital dispensing unit previously disclosed in U.S. Pat. No. 9,718,082 ("Inline Dispense Capacitor") and US patent application publication serial numbers US 2018/0046082 ("High Purity Dispense Unit"), US 2018/0047562 ("High Purity Dispense System") and US 2018/0047563 ("High Purity Dispense System With Meniscus Control"), with a novel mixer design that provides precision mixing qualities required for semiconductor processing and provides desired dynamic response across the entire dispense time frame.

There are multiple approaches to mixing liquids. The multiple approaches can be generalized into two main groups. The first group is the use of chaotic, turbulent currents to fold and mix fluids together. The second group, which also plays a role in the first group, is mixing through diffusion. Turbulent mixers by their nature contain uncontrolled flows, with constantly changing eddies and flow of patterns. While turbulent flows have the potential to quickly create uniform mixing with steady state flow inputs, their random nature is a concern with the precision uniformity requirements of semiconductor chemicals, as well as with their output response to dynamically changing inputs. Mixing through diffusion, however, is defined by Fick's Law and is a function of concentration gradient, distance and time. The concentration gradient is defined by the mixer inputs. For semiconductor applications, it is desired herein to mix chemicals in as short of time as possible. This leaves one variable, distance, as the operative focus of designs herein.

Figure 1A:
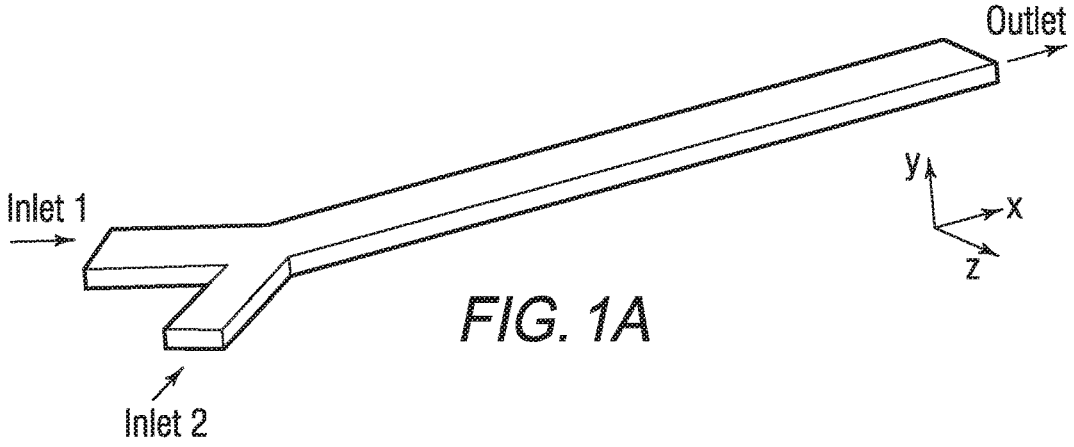
FIG. 1A shows a schematic example of a microfluidic mixer.
Figure 1B:
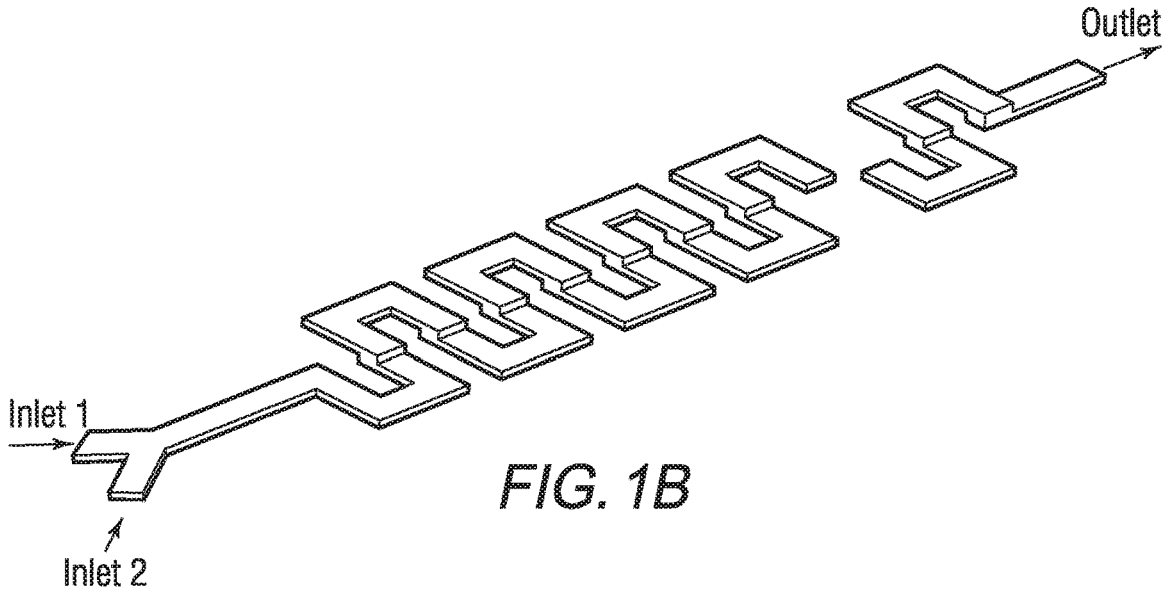
FIG. 1B shows a schematic example of another microfluidic mixer.
Figure 1C:
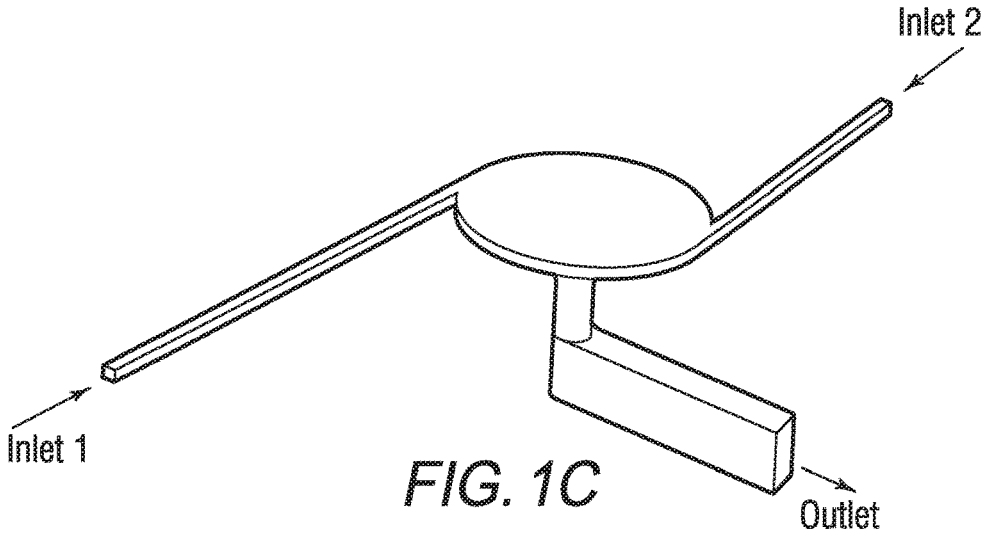
FIG. 1C shows a schematic example of another microfluidic mixer.

Techniques herein incorporate microfluidic mixers (FIGS. 1A-1C) which mix chemicals in channels with widths and depths measured in micrometers. The small dimensions of such channels eliminate any possibility of turbulent mixing. Accordingly, flows mix entirely through diffusion in a completely laminar flow. The extremely short distance perpendicular to the flow for diffusion to take place provides rapid mixing. The length of the channel, combined with the flow rate of the fluid, determine the mix quality at the output of the channel in a predictable, repeatable way. A change in input flows will result in predictable, repeatable change in output concentration after passage through the channel. These attributes are desired for semiconductor fabrication. The channel size, however, can significantly restrict flowrate. Embodiments herein scale the channel size such as by having a first mixer configuration as an array of parallel channels with dual inputs that are of micrometer size in width and depth (FIGS. 1A and 1B), and of a number necessary to support a desired flow rate. Considering that only the axis (Y axis in FIGS. 1A and 1B) that defines the thickness of the fluid layers needs to be in the micrometer range, a single flat channel, of micrometer depth and with a width large enough to support a desired flow rate (increase in the Z axis in FIGS. 1A and 1B), provides for scaling.

Another embodiment combines micrometer channel size in a slot mixer, such as that described in US patent application publication number US 2016/0250606. This embodiment includes a scaled version spiral mixing, with input directions similar to that shown in FIG. 1C. Slot heights are scaled/extended so that they are relatively large compared to slot width. By decreasing slot widths that deliver chemicals to a central chamber where streams are layered and mixed, the mix quality can be increased to the point where only a single mixing stage is required and a downstream volume from the mix chamber to the nozzle can be significantly minimized. As slot width is decreased, the flow cross section is also decreased, which in turn reduces the flow. Some embodiments address this by increasing a number of slots that feed a central chamber. Multiple feeding slots aid in rapid transition from one concentration to another while maintaining mix quality. Another embodiment includes a parallel array of slot mixers of the type shown in FIG. 1C.

Figure 2:
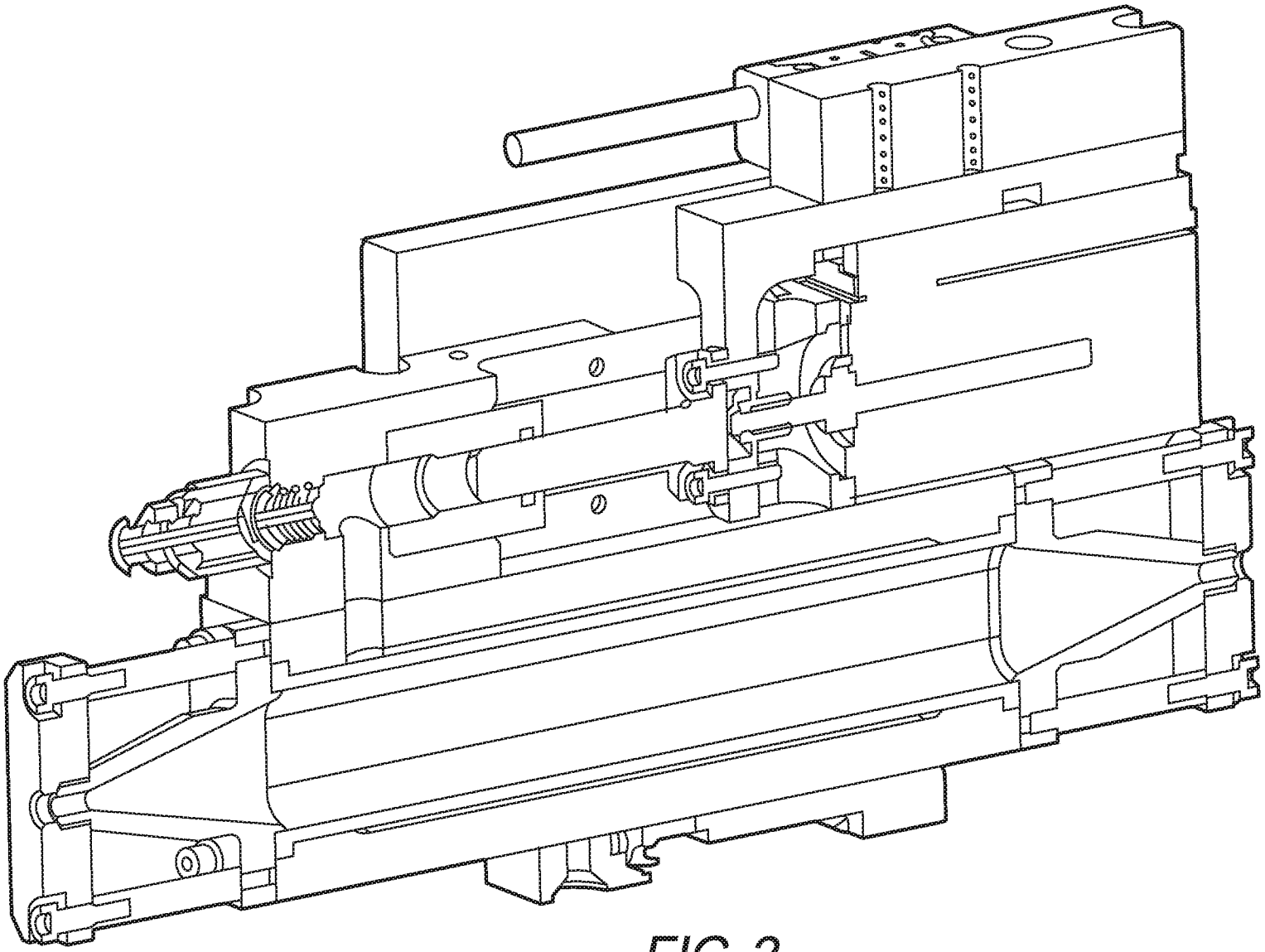
FIG. 2 shows a perspective view of a bladder-based digital dispense unit as described herein.

Embodiments herein can incorporate a precise supply of chemicals to the mixer. Two or more supply lines to the mixer can be configured, and the mixer can include two or more inputs. Various chemicals can be supplied by precision pumps or valves. In the case of pumps, various embodiments of an elongate bladder system can be used. An example is shown in FIG. 2.

In one embodiment, a mixer includes a first fluid supply line including an elongate bladder defining a linear fluid flow path and being configured to laterally expand and collect a charge of the first process fluid, and laterally contract to deliver a selected volume of the first process fluid to the mixer. The system can include a control valve between the elongate bladder unit and a mixer input. This configuration allows the valve to close and the elongate bladder to recharge. Such a valve can optionally include a suck-back feature or mechanism. A constant pressure supply can be provided by a pressurized chemistry supply container. The elongate bladder is digitally controlled and provides precision control over the supply of chemicals to the mixer. The precision control of the chemical composition of the mixer output is implemented by precision control of mixer inputs. A filter, positioned upstream from the elongate bladder unit, can be included to improve purity of the chemicals. A valve can be positioned upstream of the elongate bladder unit, and optionally before the filter if present. This valve can be used to prevent back flow when the bladder unit is dispensing through the mixer and nozzle.

Alternatively, a bladder unit supplying liquid chemicals can function without a control valve between the bladder unit and the mixer input. A nozzle with meniscus control can be included to maintain a meniscus at a desired location during recharge of the bladder unit or between dispenses. With two or more supply lines to the mixer and nozzle, each supply line can be recharged in a serial sequence. Suck back at the nozzle can be implemented by one or more bladder units. A filter, positioned upstream from the bladder unit, can improve purity of the chemicals. An optional valve positioned upstream of the bladder unit and before the filter (if included) can be used to prevent back flow when the bladder unit is dispensing through the mixer and nozzle.

Other embodiments can use adjustable valves, either pneumatically or electrically driven, to control the input flow of chemicals into the mixer, such as instead of the bladder unit. These valves can include speed controls and/or adjustable stops that limit max flow through the valves. Sequencing the valves enables phase change from chemical A to chemical B, or vice versa, during a given dispense. Speed control enables chemical blending during dispense. Suck back control may or may not be included as a valve function. A constant or variable pressure supply should be available behind the valve to push fluid through.

Mixers herein can be tightly coupled to, or integrated with, a dispensing nozzle itself. Wire electronic discharge machining (wire EDM) can be used to produce slots down to approximately 150 μm, or other techniques such as etching or additive manufacturing. For some semiconductor dispense applications, a 150 μm slot width can be too large to meet mixture uniformity targets with a single stage. For these applications, two mixers can be placed in series to meet conventional film specifications for 300 mm wafers. Techniques can benefit from using a non-metal mixer to avoid metal contamination in semiconductor manufacturing.

Dual stage embodiments can be used for some applications, but the internal volume of the mixer can be too large for applications that require dynamic variation of chemical content during dispense. Certain photoresist chemicals can be extremely expensive. This expense has driven manufacturers to reduce dispense volume size to well below 1 ml. Dynamically variable concentration is one means of reducing photoresist dispense volume. The volume from the point where the two chemicals first mix to the nozzle output represents a volume that must be displaced within the dispense to output a change in concentration. If this volume is too large, the dispense can be over before the change could reach the nozzle output.

Figure 3:
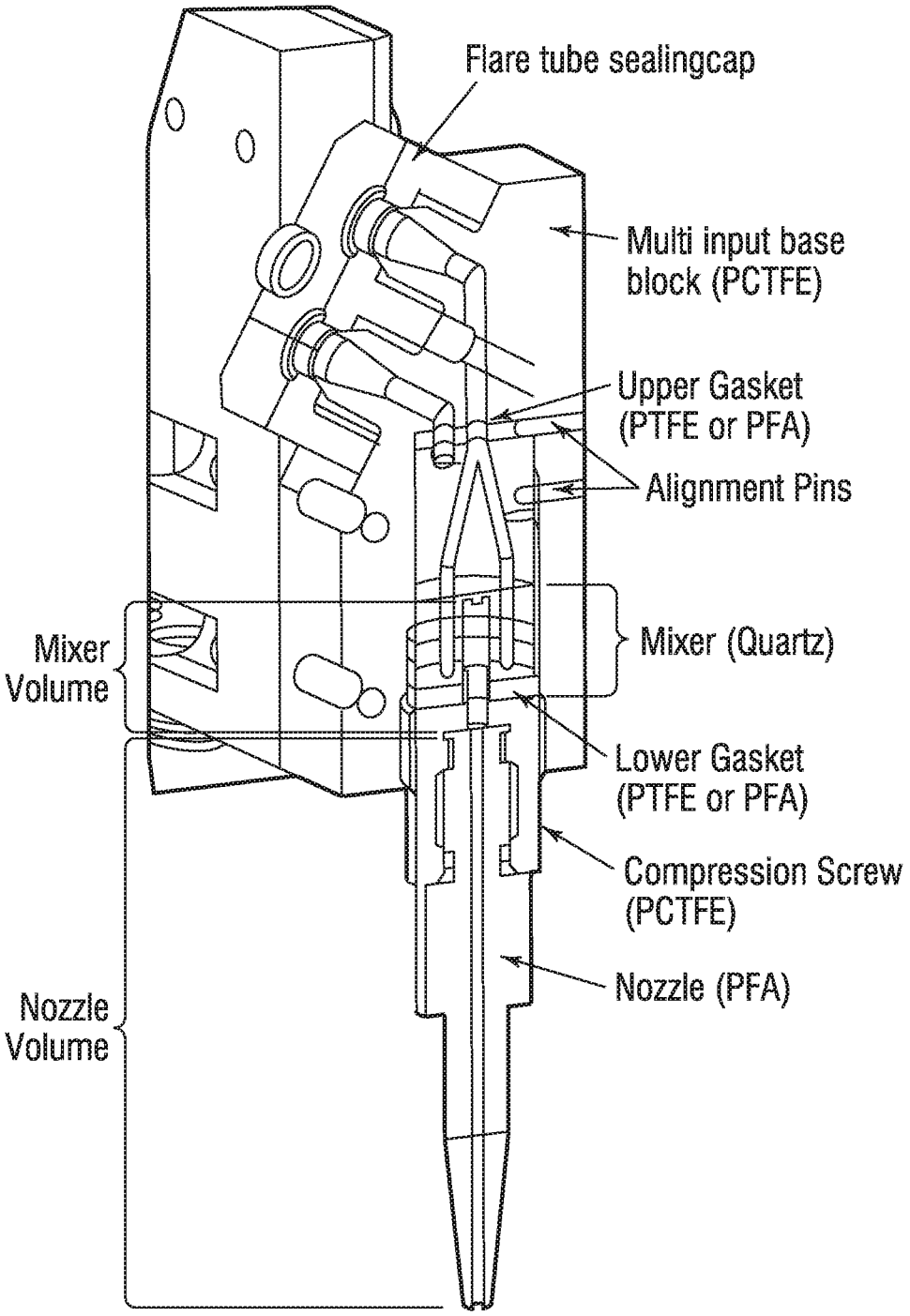
FIG. 3 shows perspective view of a nozzle assembly along with the microfluidic mixer as described herein.

A single stage embodiment is illustrated in FIG. 3. Two supply lines provide two chemicals' flows from their respective supply lines and/or bladder units. These supply lines can be clamped in place by a cap using flared tube connections or by using other connection techniques. Flow paths then enter the base block. Using a base block of PCTFE (polychlorotrifluoroethylene) is beneficial because of its chemical resistance and higher strength as compared to Teflon or PFA (perfluoroalkoxy alkanes). The mixer or mixing body can be created from quartz and is inserted into the base block. With both the base block and the mixer being made of relatively harder materials, a softer more compliant material, such as Teflon, can be used as a gasket between faces. Grooves can be machined in the face of the quartz mixer to aid in sealing. The quartz mixer can be held in place and sealed by a compression screw that screws into the base block, or other attachment mechanism. Such a screw can also be made from PCTFE to provide the strength for the screw thread and to transfer the compression force for sealing. A second Teflon gasket can be used between these two parts. Teflon gaskets can be separate pieces for some embodiments. Alternatively, they can be fused to the quartz or the mating PCTFE components to ease assembly.

Alignment pins for the upper gasket and quartz mixer can be used to ensure that the parts are properly aligned without restricting flow. The compression screw can also conveniently provide a receiving thread for conventional nozzles. This assembly is relatively compact. By way of a non-limiting example, the quartz mixer can be 16.35 mm long and have an 8.8 mm diameter. Volume of the mixer chamber is approximately 0.017 ml. A flow shaft through the gasket and compression screw has a volume of approximately 0.012 ml. The flow shaft through a conventional nozzle is approximately 0.020 ml, which can optionally be reduced. From a point of first mixing to nozzle output there is flow path volume of approximately 0.049 ml which allows for concentration variation within a 0.2-2 ml dispense range.

Figure 4B:
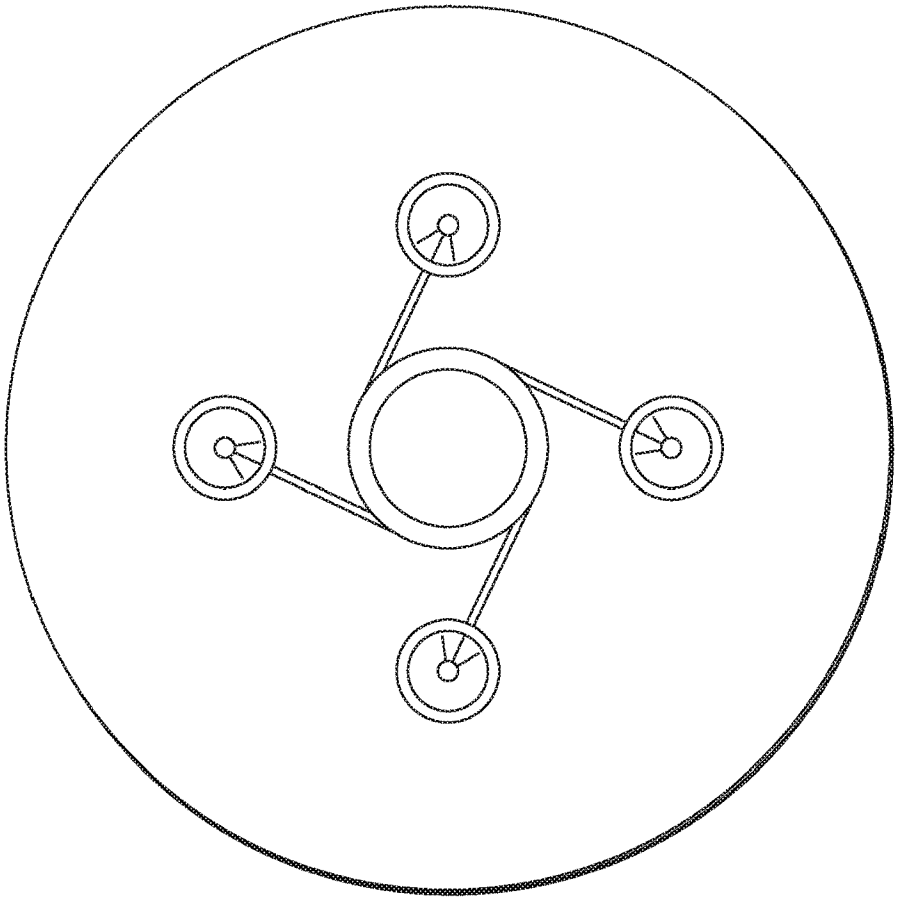
FIG. 4B shows a cross section of the lower portion of the microfluidic mixer of FIG. 4A.
Figure 4A:
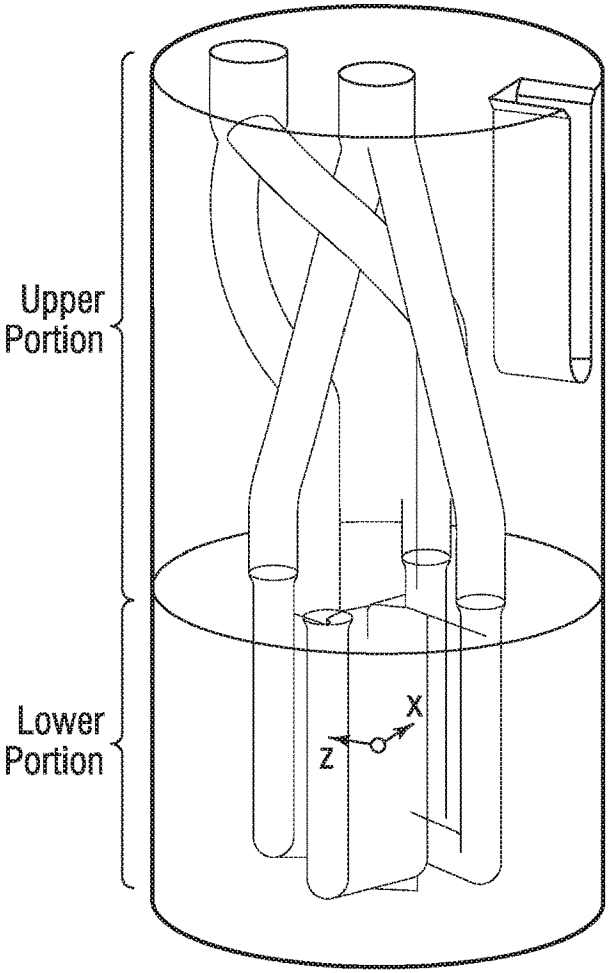
FIG. 4A shows an embodiment of the microfluidic mixer.

The mixer component, as shown in FIGS. 4A, 4B, is embodied as a monolithic component incorporating an upper portion that divides the two flow inputs and directs them to the four inputs of the lower mixer section. In other embodiments, additional inputs can be used to improve flow rate, depending on a specified end use or desired flow rate. Each of these four channels is fed to the central mixing chamber by narrow tangential slots. Slot width can be manufactured from 60 μm wide to 90 μm wide. Channels can be approximately 5 mm high. The quartz mixer can be created by additive manufacturing or etching, et cetera. For example, internal passageways can be etched inside a quartz piece via a laser and chemical etch process. Upper and lower sections can be manufactured as separate pieces and fused together to create a single piece. Increased volume flow can be achieved by stacking the mixer components, such as those shown in FIGS. 4A, 4B. Stacking mixer components is also equivalent to increasing channel height. Channel height can also be increased directly. Mixer units can also be positioned in parallel if more flow is needed.

Figure 5A:
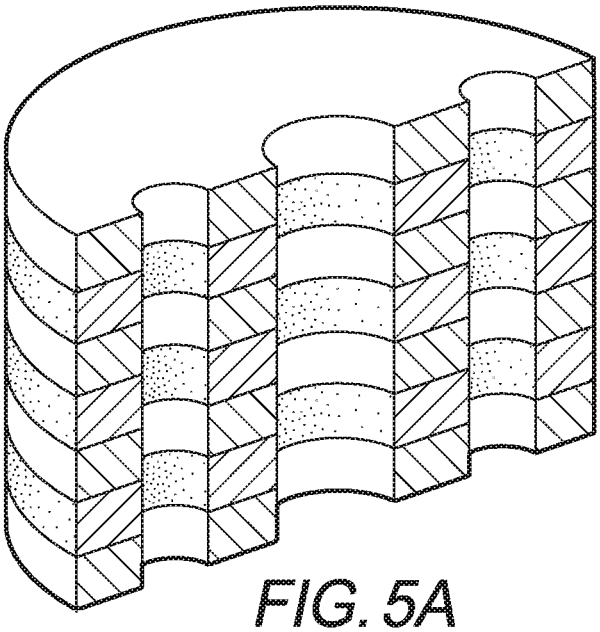
FIG. 5A shows an embodiment of the microfluidic mixer.
Figure 5B:
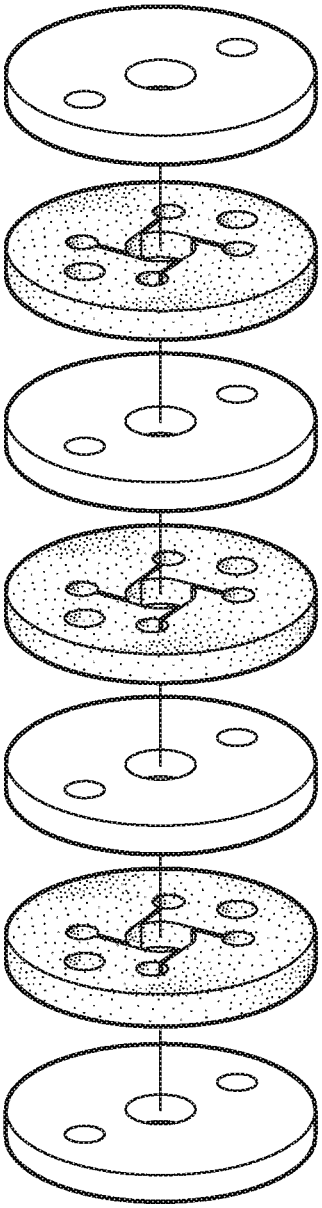
FIG. 5B shows another perspective view of the microfluidic mixer of FIG. 5A.

In an alternate configuration, the mixer is assembled as a stacked mixer in which a mixer is etched through silicon wafers which are then stacked and interlaced with PTFE gaskets. FIGS. 5A and 5B illustrate this assembly. Assembling a microfluidic slot mixer with a set of disks can achieve slots widths down to 10 microns and lower.

Figure 6:
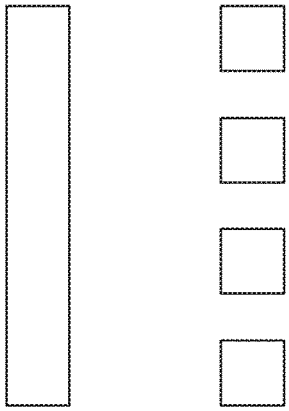
FIG. 6 shows a schematic of a cross section of a slot of a microfluidic mixer.

In another embodiment, the slot mixer can be separated in the z-axis to allow for 2D diffusion. For example, FIG. 6 illustrates a cross section of a slot, which is a rectangle. By separating this rectangle into a series of squares or smaller slots, fluid can diffuse vertically as well as horizontally. Such inputs can be staggered with each other, alternated, or used in place of a single, rectangular slot. Also, a first input can be staggered with a second input.

Figure 7:
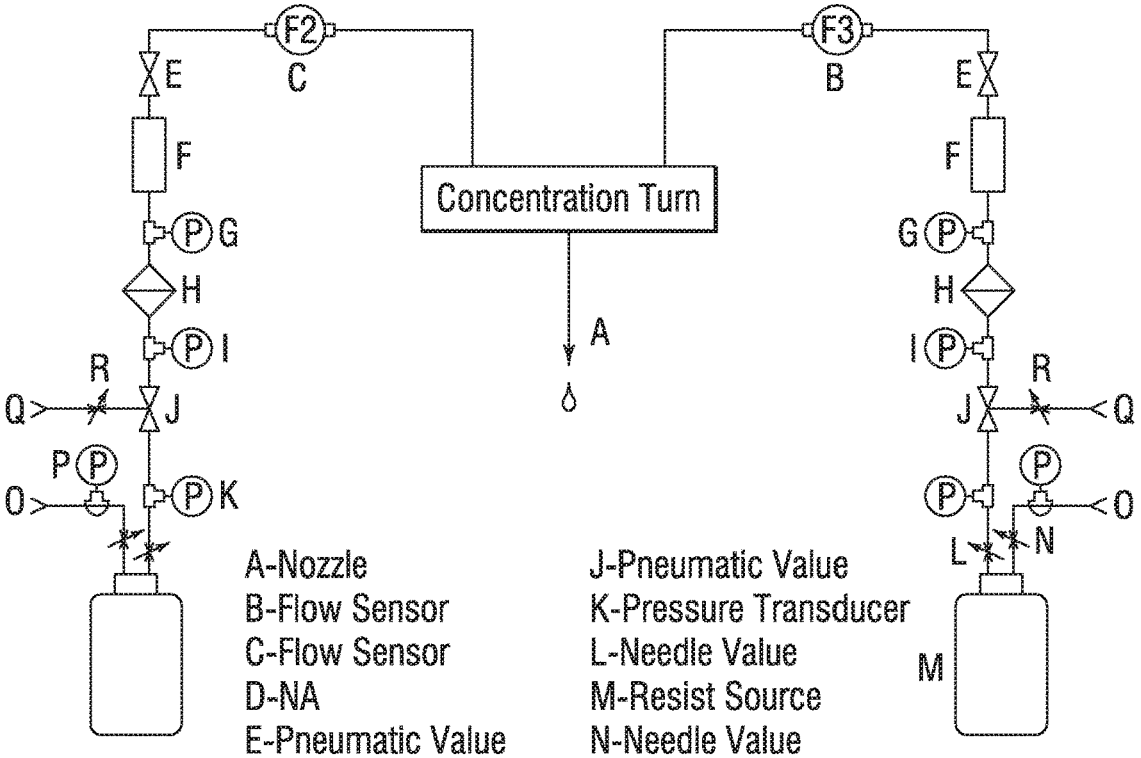
FIG. 7 shows a schematic of a full dispense system.

Referring now to FIG. 7, a full dispense system is shown. In FIG. 7, the mixer is referred to as the Concentration Tuner. Not all the components are necessary for an on tool production implementation of this system, thus there are many options and variations contemplated.

Accordingly, various methods herein can mix chemicals at ratios that are dynamically changing, phasing, or that are static. One or multiple bladder-based fluid delivery lines can be used. Fluids can be pre-blended using a microfluidic mixer and then held for dispense. A second fluid can be pulsed into a first fluid. Various mixing modes can be configured. The quartz mixer can be positioned adjacent to a dispense nozzle. For a cylindrical mixing chamber, a conical member can fill in a fluid dead zone at a top of the chamber. With techniques herein, nozzle tips can be reduced from 20 mm to about 3 mm. Premixed resist can be used in one line, with additional solvent mixed in to help with uniformity.

Uniformity herein can refer to thickness variations of a given film from wafer edge to wafer center. In other words, techniques herein help achieve a flatter film. For example, a given film thickness is targeted at 70 nm, but at the edge of wafer the thickness can be several nanometers shorter at the edge. By reducing an amount of resist dropped off at the outer edge, but with blending techniques herein, thickness uniformity can be maintained, for example, blending in a pulse of solvent during the dispense. Other techniques can use pressure based, valve timing, with various types of pumps. Accordingly, uniformity of resist thickness across the wafer can be achieved herein.

Other aspects of techniques herein enable improvements in uniformity and resist usage. In the photolithography process, a photoresist is applied as a thin film to a substrate (wafer). Conventional photoresists are three-component materials that include: (1) a resin, which serves as a binder and establishes the mechanical properties of the film; (2) a sensitizer, which is a photoactive compound (PAC); and (3) a solvent, which keeps the resin in a liquid state until it is applied to the substrate being processed. A typical spin coat process involves depositing a puddle of liquid photoresist onto the center of a substrate then spinning the substrate at high speed (typically around 1500 rpm). Centripetal acceleration causes the resist to spread to the edge of the substrate and eventually off the substrate leaving a thin film of resist on the surface. Final film thickness and other properties will depend on the nature of the resist (viscosity, drying rate, percent solids, surface tension, etc.) and the parameters chosen for the spin process. Factors such as final rotational speed, acceleration, and solvent evaporation contribute to determine how the properties of coated films are defined. The drying rate of the resist during the spin cycle is mostly dependent on the volatility of the solvent. The solvent component in the resist has a high evaporation rate, causing the film to dry out before the resist gets to the edge of the substrate. To compensate, conventional systems dispense a much larger photoresist volume than needed to simply cover the wafer, producing a significant volume of wasted material. Due to the extremely high cost of liquid photoresist, this creates a significant cost factor in semiconductor manufacturing.

Solvent evaporation has been determined to be a dominant factor in photoresist coverage and it presents a roadblock to further consumption reduction. The conventional method to reduce the resist dispense amount is to dispense a rinse solvent before spin coating the photoresist. The solvent dispense before the resist dispense is referred to as the "reduction resist consumption (RRC)" solvent. The RRC process, however, has issues and limitations. The solvent is easily evaporated and thus the RRC solvent at wafer edge may be less than that at wafer center, causing insufficient resist coverage at lower dispense volumes. Additionally, the RRC process uses a high volume of solvent which increases the lithography cost and generates harsh chemical waste. Given the above, there is still a need for the further reduction of the resist dispense amount while improving coating thickness uniformity in order to further reduce the resist consumption cost as well as protect the environment by using less harsh chemicals.

Embodiments herein provide a chemical dispense apparatus, which reduces the resist dispense amount while producing a high quality film. A point-of-use dynamic dispense of solvent/resist mixing is used. Some examples of solvents that can be used include, but are not limited to, PGMEA, OK73, PGEE, Cyclohexanone, 4M2P, et cetera.

The RRC process can be reproduced in a single dispense, which has two benefits. First, using a single dispense reduces total process time, thereby improving wafer throughput. Secondly, evaporation from the primary solvent dispense helps to saturate the local environment with solvent vapor, which reduces solvent evaporation from the resist dispense. By eliminating the delay between the two dispenses, this effect is enhanced because the solvent vapors have less time to diffuse away from the wafer surface.

Figure 8:
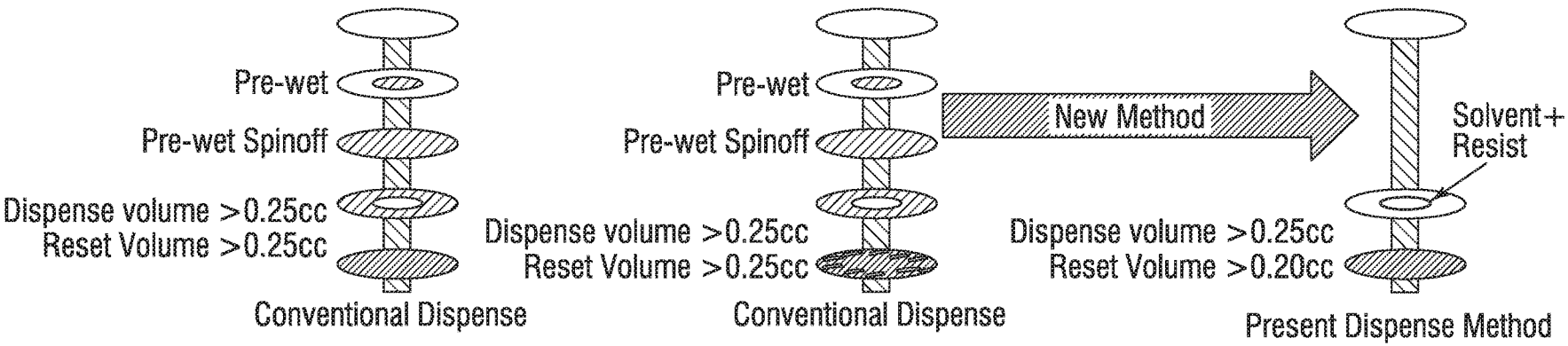
FIG. 8 illustrates a resist reduction mechanism as described herein.

Hardware described herein enables a second application in which the dispense starts as solvent only, providing a leading edge that will wet the wafer, followed by a short blending from solvent to resist before pure resist dispense is made. This method provides the leading edge of resist, which is subject to premature drying, an extra volume of solvent so that by the time the flow has reached the edge of the wafer, the proper viscosity of the liquid is still maintained. The ratio of the mixing can range from 1%-99% solvent/resist or resist/solvent. An example amount is 0.1-1.0 cc of pure resist volume, see FIG. 8.

Hardware described herein can use a single chemical (resist, developer, rinse agent, metal or non-metal solutions, organic or inorganic solutions, et cetera) concentration and uniformly blend in a solvent, or other chemical, to produce a different viscosity or other liquid property. In the case of photoresist this can be used to produce various resist thicknesses from a single liquid photoresist source. Furthermore this concentration can be dynamically varied during the dispense to produce any desired effect.

Figure 9A:
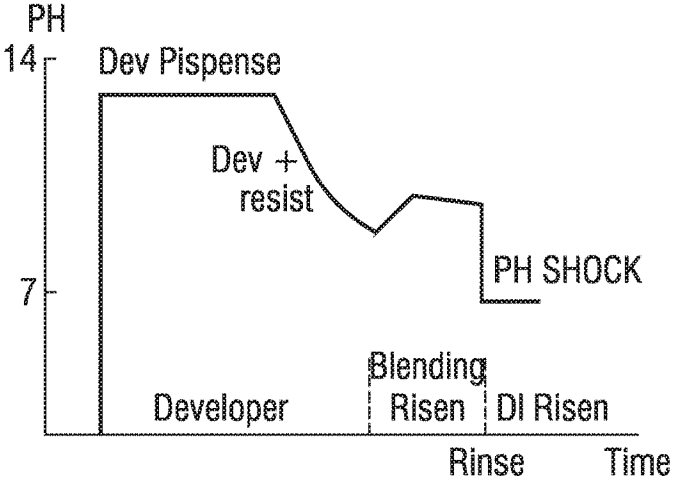
FIGS. 9A and 9B illustrate a pH shock elimination mechanism as described herein.
Figure 9B:
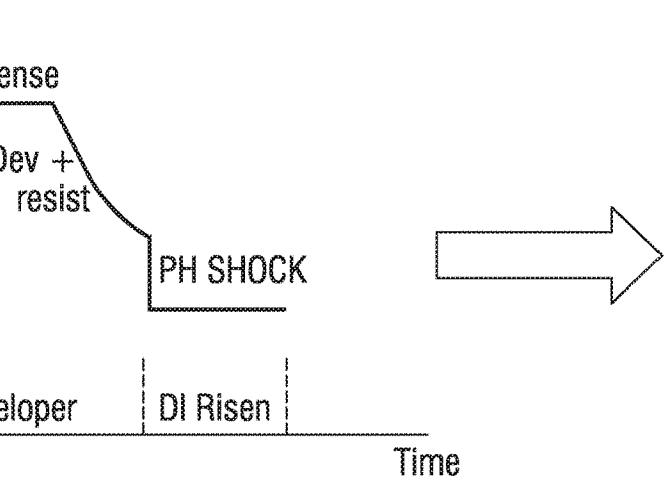

Hardware described herein can be used to provide variable blending within the dispense to reduce undesirable effects of changing chemicals too quickly, such as the elimination of the negative effects of rapid changes in pH during TMAH/DI water photoresist developer process. Photoresist residue can be left behind when a photoresist developer is rinsed from the wafer with pure DI water. The rapid drop in pH level causes some of the dissolved resist to precipitate out of solution leaving behind resist residue on the wafer. This is avoided by the technique disclosed herein (See FIGS. 9A, 9B).

Hardware described herein enables implementation of chemical mixtures and solutions that were previously unavailable to be used in production due to the fact that the solutions were unstable and the solutions reacted, decomposed, or precipitated out of solution in a very short period of time. By mixing reactive components directly at the point of use, these chemicals can now be dispensed in production without concern for the shelf life of the chemical.

Embodiments described herein can be used to uniformly mix more than two chemicals at once. Moreover, any combination or sequence of mixed or pure chemicals within a single dispense can be provided in order to tune any specific film property, such as thickness uniformity, global and local wafer planarization, adjustment of surface interaction, conformal coatings, etc.

In the preceding description, specific details have been set forth, such as a particular geometry of a processing system and descriptions of various components and processes used therein. It should be understood, however, that techniques herein may be practiced in other embodiments that depart from these specific details, and that such details are for purposes of explanation and not limitation. Embodiments disclosed herein have been described with reference to the accompanying drawings. Similarly, for purposes of explanation, specific numbers, materials, and configurations have been set forth in order to provide a thorough understanding. Nevertheless, embodiments may be practiced without such specific details. Components having substantially the same functional constructions are denoted by like reference characters, and thus any redundant descriptions may be omitted.

The invention claimed is:

1. An apparatus for dispensing fluid, the apparatus comprising:

a mixer configured to receive at least two fluids for mixing, the mixer being a microfluidic mixer configured to combine at least two fluids using slot-shaped fluid conduits;

a nozzle positioned proximate to the mixer to receive mixed fluids for dispense;

a first fluid supply line connected to the mixer and configured to controllably supply a first process fluid into the mixer, the first fluid supply line including an elongate bladder defining a linear fluid flow path and being configured to laterally expand and collect a charge of the first process fluid, and laterally contract to deliver a selected volume of the first process fluid to the mixer;

a second fluid supply line connected to the mixer and configured to controllably supply a second process fluid into the mixer to deliver a selected volume of the second process fluid to the mixer; and a controller configured to dynamically control delivery of the first process fluid and the second process fluid independent of each other.

2. The apparatus of claim 1, wherein the mixer includes one or more first inlets for receiving the first process fluid, and one or more second inlets for receiving the second process fluid, the mixer transforming a fluid flow path of each process fluid into a slot-shaped flow path.

3. The apparatus of claim 2, wherein each slot-shaped fluid conduit has a height dimension that is at least ten times greater than a width dimension.

4. The apparatus of claim 2, wherein the mixer includes a cylindrical mixing chamber that receives at least one slot-shaped fluid conduit for each process fluid, the mixer directing each process fluid along a circumference of the cylindrical mixing chamber.

5. The apparatus of claim 4, wherein the mixer is configured to direct each process fluid to mix within the cylindrical mixing chamber is a spiral flow.

6. The apparatus of claim 2, wherein the mixer joins the slot-shaped fluid conduits together into a slot-shaped mixing conduit.

7. The apparatus of claim 6, wherein the slot-shaped mixing conduit is sized to prevent turbulent mixing flow.

8. The apparatus of claim 6, wherein the slot-shaped mixing conduit is sized to provide laminar flow of each process fluid such that the process fluids mix by diffusion.

9. The apparatus of claim 1, wherein the nozzle includes an inlet that receives a mixed process fluid from the mixer and a nozzle tip for dispensing the mixed process fluid onto a substrate.

10. The apparatus of claim 9, wherein the mixer is positioned less than 25 millimeters away from the nozzle.

11. The apparatus of claim 9, wherein the apparatus has a fluid conduit volume of less than 0.1 ml between a point of mixing each process fluid and the nozzle outlet.

12. The apparatus of claim 1, wherein the mixer has a length less than 40 mm and a width less than 20 mm, and wherein the nozzle has a length less than 30 mm.

13. The apparatus of claim 1, wherein the process fluid supply lines, the mixer and the nozzle are all aligned to provide laminar flow from the process fluid supply lines to the nozzle outlet.

14. The apparatus of claim 1, wherein the mixer is positioned within 30 millimeters of a dispense nozzle outlet.

15. The apparatus of claim 1, wherein the microfluidic mixer includes slot-shaped fluid conduits having a width of less than 200 microns, and a length less than 15 millimeters.

16. The apparatus of claim 1, wherein the mixer is made of quartz.

17. The apparatus of claim 1, wherein the mixer is formed by combining multiple discs.

18. The apparatus of claim 1, wherein a total internal volume of fluid conduits of the mixer is less than 0.1 ml.

19. The apparatus of claim 1, wherein the mixer includes grooves formed in quartz interfaces to enable sealing components together to keep a laminar flow.

20. A method for dispensing fluid, the method comprising:

mixing a first process fluid with a second process fluid proximate a dispense nozzle using a mixer that is a microfluidic mixer, the microfluidic mixer configured to combine at least two fluids using slot-shaped fluid conduits;

supplying a first process fluid to the mixer using a first fluid supply line configured to control volume of the first process fluid into the mixer using an elongate bladder defining a linear fluid flow path, the elongate bladder being configured to laterally expand and collect a charge of the first process fluid, and laterally contract to deliver a selected volume of the first process fluid to the mixer;

supplying a second process fluid to the mixer using a second fluid supply line configured to control volume of the second process fluid delivered to the mixer; and dispensing mixed process fluid onto a substrate via the dispense nozzle, wherein the mixer mixes the first process fluid with the second process fluid proximate the dispense nozzle such that a volume of mixed process fluid between the mixer and an outlet of the dispense nozzle is less than 0.1 ml.

* * * * *